US009414652B2

(12) United States Patent
Fuhrman et al.

(10) Patent No.: US 9,414,652 B2
(45) Date of Patent: Aug. 16, 2016

(54) SLIDING MAGNETIC JEWELRY CLASP AND METHOD OF USING THE SAME

(71) Applicant: EF Designs, Ltd., Weehawken, NJ (US)

(72) Inventors: Robert Fuhrman, Weehawken, NJ (US); Esther Fuhrman, Weehawken, NJ (US)

(73) Assignee: EF DESIGNS, LTD.NJ (US)

( * ) Notice: Subject to any disclaimer, the term of this patent is extended or adjusted under 35 U.S.C. 154(b) by 209 days.

(21) Appl. No.: 14/184,349

(22) Filed: Feb. 19, 2014

(65) Prior Publication Data

US 2015/0230565 A1 Aug. 20, 2015

(51) Int. Cl.
*A44C 5/20* (2006.01)

(52) U.S. Cl.
CPC ..... *A44C 5/2071* (2013.01); *A44C 5/2023* (2013.01); *A44D 2203/00* (2013.01); *Y10T 24/32* (2015.01)

(58) Field of Classification Search
CPC ..... A44C 5/2071; A44C 5/2023; A44D 2203/00; Y10T 24/32
See application file for complete search history.

(56) References Cited

U.S. PATENT DOCUMENTS

| | | | |
|---|---|---|---|
| 468,677 | A | 2/1895 | Maxheimer |
| 1,441,999 | A | 1/1923 | Posner |
| 1,807,293 | A | 5/1931 | Keller |
| 2,178,572 | A | 11/1939 | Forstner |
| 2,654,929 | A | 10/1953 | Feibelman |
| 3,177,546 | A | 4/1965 | Bey |
| 4,426,854 | A | 1/1984 | Geldwerth |
| 4,530,221 | A | 7/1985 | Weinberg |
| 4,622,726 | A | 11/1986 | Nakamura |
| 5,008,984 | A | 4/1991 | Levy |
| 5,050,276 | A | 9/1991 | Pemberton |
| 5,092,019 | A | 3/1992 | Levy |
| 5,197,168 | A | 3/1993 | Levy |
| 5,311,647 | A | 5/1994 | Levy |
| 5,317,789 | A | 6/1994 | Levy |
| 5,349,725 | A | 9/1994 | Levy |
| 5,367,891 | A | 11/1994 | Furuyama |
| 5,572,887 | A | 11/1996 | Geswelli |
| 5,664,298 | A | 9/1997 | Nessar-Ivanovic |
| 6,481,065 | B2 | 11/2002 | Cogdill |
| 6,505,385 | B2 | 1/2003 | Grunberger |
| 6,591,462 | B2 | 7/2003 | Fuhrman |
| 6,640,398 | B2 | 11/2003 | Hoffman |
| 7,073,232 | B1 | 7/2006 | Fuhrman |

FOREIGN PATENT DOCUMENTS

| | | | |
|---|---|---|---|
| EP | 462072 | A1 | 12/1991 |

*Primary Examiner* — Robert J Sandy
*Assistant Examiner* — Louis Mercado
(74) *Attorney, Agent, or Firm* — Feldman Law Group, P.C.; Stephen E. Feldman

(57) ABSTRACT

A jewelry clasp includes a first housing having a first locking member and securing a first magnetic configuration and a second housing having a second locking member and securing a second magnetic configuration. The first and second magnetic configurations have exposed faces with a north pole being positioned at a first side of the exposed face and a south pole being positioned at a second side of the exposed face. The jewelry clasp further includes a magnetic locking arrangement wherein the north pole and south pole of the first magnetic configuration are magnetically attracted and aligned with the south pole and the north pole of the second magnetic configuration and a mechanical locking arrangement wherein the first locking member slidably interlocks with a second locking member during alignment of the mechanical locking arrangement.

13 Claims, 7 Drawing Sheets

SLIDING MAGNETIC JEWELRY CLASP AND METHOD OF USING THE SAME

BACKGROUND

The disclosed technology relates to a jewelry clasp. More particularly, to a jewelry clasp for easily joining the two free ends of a jewelry chain together.

With certain jewelry, particularly women's jewelry, there is an inherent conflict between the need to make the clasp easy to facilitate so that the wearer can readily join the free ends of the bracelet or necklace, and the need to make the clasp very secure so that it does not easily and inadvertently become unattached and risk the potential loss of the jewelry.

In use, even people with a great deal of dexterity find it difficult to fasten necklaces behind their necks or fasten most bracelets which, by their nature, must be fastened with the use of only one hand. This problem is compounded many fold in the case of older people or the many millions of people who suffer from even mild cases of arthritis or similar afflictions that limit the use of the hands.

Magnetic clasps are widely used for costume jewelry. However, manufacturers and retailers of fine jewelry (gold jewelry, sterling silver jewelry or jewelry containing gemstones) offer necklaces with magnetic clasps less frequently. Makers and wearers of fine jewelry usually opt for security over ease of use.

SUMMARY

A jewelry clasp comprising: a first housing, the first housing for securing a first magnetic configuration, the first magnetic configuration having an exposed face with a north pole being positioned at a first side of the exposed face and a south pole being positioned at a second side of the exposed face, the first housing further including a first locking member; a second housing, the second housing for securing a second magnetic configuration, the second magnetic configuration having an exposed face with a south pole being positioned at a first side of the exposed face and a north pole being positioned at a second side of the exposed face, the second housing further including a second locking member; a magnetic locking arrangement wherein the north pole and south pole of the first magnetic configuration is magnetically attracted and aligned with the south pole and the north pole of the second magnetic configuration; and a mechanical locking arrangement wherein the first locking member slidable interlocks with a second locking member during alignment of the first locking arrangement.

In some implementations, the first locking member can include at least two posts and at least two post extenders and the second locking member can include at least two notches wherein the at least two post and at least two post extenders slidably interlock with the at least two notches. In another implementation, the first locking member can include at least one post and ball and the second locking member can include at least one holder wherein the at least one post and ball slidably interlocks with the at least one holder.

In other implementations, the first housing and the second housing can have an ornamental design on at least one surface of the respective housings.

The advantages of the jewelry clasp are that the clasp easily closes, is secure when closed, and is easily opened when you know how. Another advantage is that the jewelry clasp is counterintuitive meaning that when opening the clasp a user cannot pull clasp apart or pry the housings away from one another but must push the housing inwards towards one another thereby disengaging the mechanical clasp and naturally breaking the magnetic attraction between the housing and naturally pushing like poles towards one another to induce magnetic repulsion. In addition to those functional advantages, the clasp is commercially benefited by being attractive so that the clasp enhances, rather than detracts, from the overall attractive appearance of the jewelry itself.

DETAILED DESCRIPTION

Figure 1:
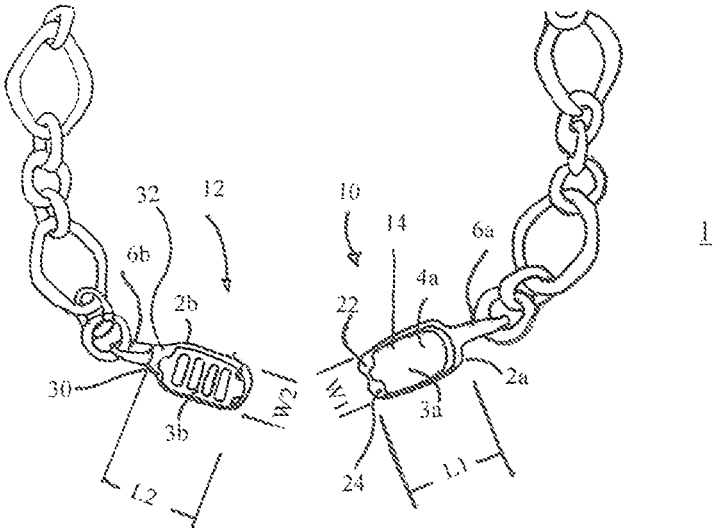
FIG. 1 shows a perspective view of an underside of an unconnected jewelry clasp of the disclosed technology.
Figure 2:
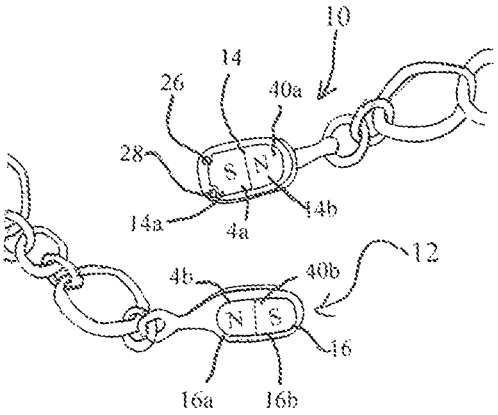
FIG. 2 shows an underside of a first housing and a top surface of a second housing of an unconnected jewelry clasp of the disclosed technology.
Figure 3:
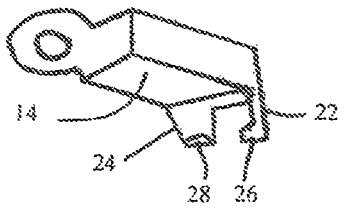
FIG. 3 shows a perspective view of a first housing of the disclosed technology.
Figure 4:
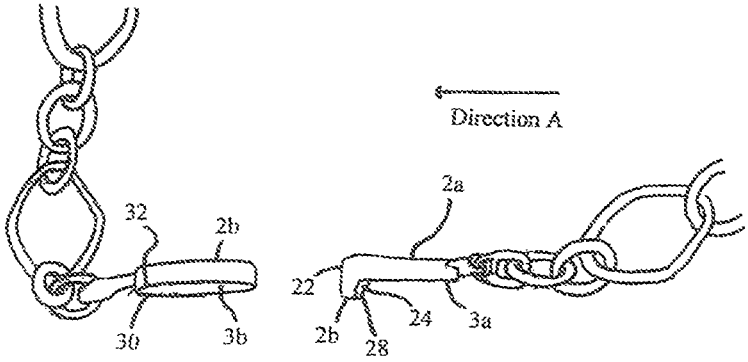
FIG. 4 shows a side view of an unconnected jewelry clasp of the disclosed technology.
Figure 5:
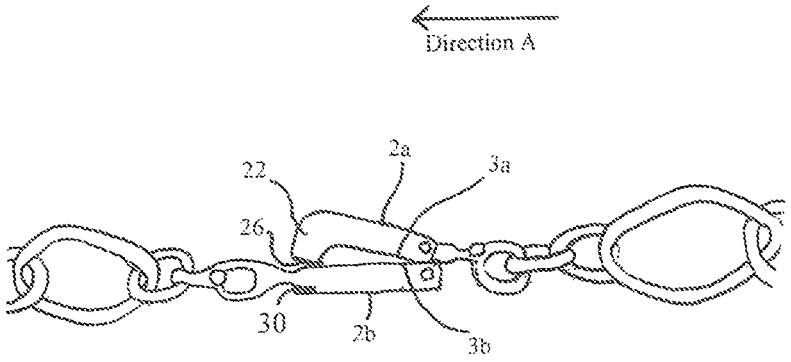
FIG. 5 shows a side view of a partially connected jewelry clasp of the disclosed technology.
Figure 6:
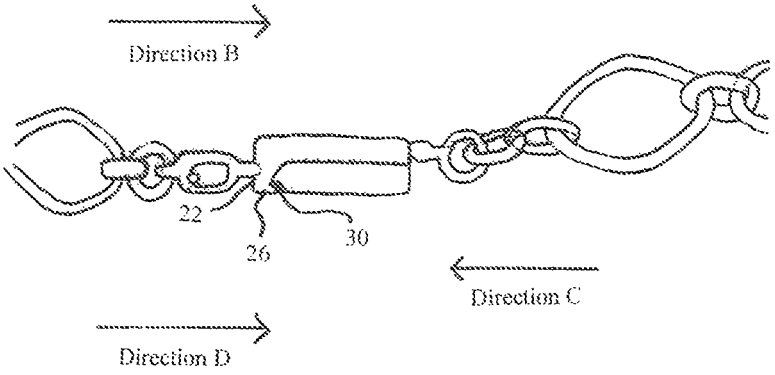
FIG. 6 shows a side view of a connected jewelry clasp of the disclosed technology.
Figure 7:
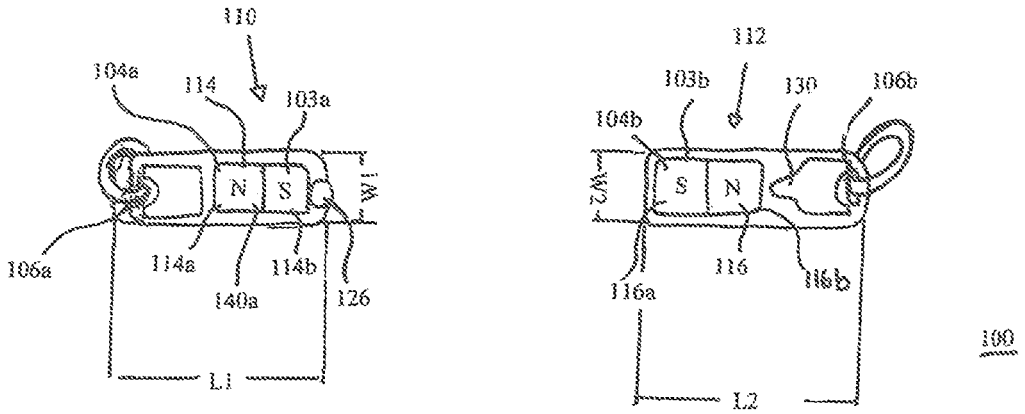
FIG. 7 shows an underside of a first housing and a top surface of a second housing of an unconnected jewelry clasp of the disclosed technology.
Figure 8:
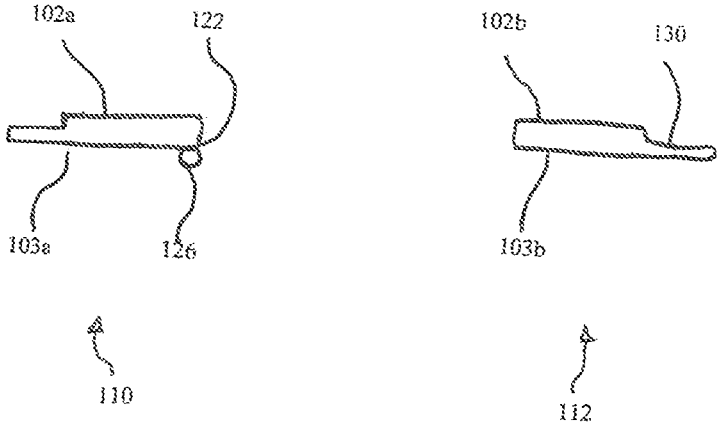
FIG. 8 shows a side view of an unconnected jewelry clasp of the disclosed technology.
Figure 9:
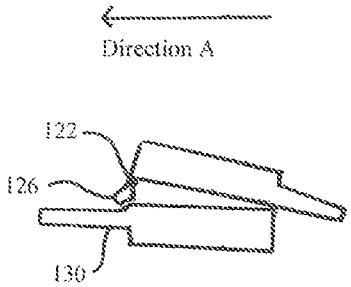
FIG. 9 shows a side view of a partially connected jewelry clasp of the disclosed technology.
Figure 10:
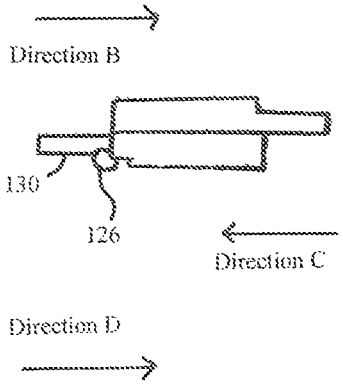
FIG. 10 shows a side view of a connected jewelry clasp of the disclosed technology.

This specification describes technologies relating to jewelry clasps. FIGS. 1-6 show one implementation of a magnetic jewelry clasp. The clasp 1 includes two housings 10, 12 adapted to be joined together in a mechanical locking arrangement and a magnetic locking arrangement. The housings 10, 12 can be made of many materials, preferable of the metal material, such as silver or gold that is the same as the material used in the piece of jewelry on which the clasp is being used. The clasp can be used with any jewelry with connecting ends, e.g., necklaces, bracelets, watches, etc. There also are many industrial applications that may also take advantage of jewelry clasp functionality, e.g., in any application where two ends of chain or rope need a strong and easily removable joining mechanism. These clasps can be of any size depending on the application.

Housing 10 has a length L1 and a width W1 with an overall oval shape (please note, the housing can be formed in most shapes, e.g., round, square, etc.). The length of housing 10 can be approximately 5 to 15 mm and the width can be approximately 0.5 to 2 mm. The housing 10 includes a top surface 2*a*, a bottom surface 3*a*, a recess 4*a* for holding a magnet 14, a set of locking post 22, 24, and a connector 6*a*.

The locking posts 22, 24 extend downwards from the top surface of housing 10. At a bottom portion of each locking post is a locking extender 26, 28. The locking extenders 26, 28 extend perpendicular from the locking post 22, 24. The top surface of the housing may or may not have an ornamental design.

Housing 10 and housing 12 are similar in shape and size with variations for a locking mechanism. As such, housing 12 also has a length L2 and a width W2 with an overall oval shape. For example, the length of housing 12 can be approximately 5 to 15 mm and the width can be approximately 0.5 to 2 mm. Housing 12 includes a top surface 2*b*, a bottom surface 3*b*, and a recess 4*b* for holding a magnet 14, a connector 6*b* and a set of notches 30, 32.

The set of notches 30, 32 are located on the bottom surface 3*b* of the housing 12 and the notches 30, 32 have a shape that mirrors the shape of locking extenders 26, 28. As will be described in more detail below, the locking posts 22, 24, the locking extenders 26, 28 and the notches 30, 32 are part of the mechanical locking arrangement of the clasp 1.

In each recess 4*a*, 4*b* there is a magnetic configuration embedded and affixed within each of the housings 10, 12. The magnetic configuration can comprise permanent magnets 14, 16. The magnets 14, 16 are part of a magnetic locking arrangement for the clasp 1. The permanent magnets 14, 16 can be arranged along a longitudinal line extending between the magnets and the polarity of each of the permanent magnets 14, 16 is predetermined. In some implementations, the line of greatest magnetic attraction between the permanent magnets 14, 16 is perpendicular to a top surface 40*a*, 40*b* of the magnets. The top surface 40*a* of magnet 14 and the bottom surface 40*b* of magnets 16 each have a south pole 14*a*, 16*a* and north pole, 14*b*, 16*b*, respectively. In another implementation, there may be a magnet pair of opposite poles being positioned next to each other. In either case, the magnets 14, 16, as well as the other magnets described herein with respect to other embodiments of the invention, can be bi-polar rare-earth neodymium magnets, sintered, N50 strength, with strongest magnetic power through the thickness. Such magnets have the strongest magnetic power for their size of any known current magnet, however, magnets with lesser power can perform effectively in the present clasp design. The magnets are preferably plated to improve the appearance and prevent surface abrasion or corrosion.

In use, a user brings the two clasps in close proximity to each other (Direction A) and the magnets 14, 16 of the clasp will naturally align with one another. That is, the south pole 14*a* of magnet 14 aligns with the north pole 16*b* of magnet 16 and the south pole 16*a* of magnet 16 is aligns with the north pole 14*b* of magnet 16. Thus, the magnetically attractive surfaces 18, 20 are attracted to each other by the mating of the opposite poles of the individual bi-polar magnets or magnet pairs. However, when the two housing 10, 12 are first attracted to each other, the locking posts interfere with the magnetic locking arrangement and do not allow the magnets to lie flat against one another. (See FIG. 5). To lock the clasp, a user pushes housing 12 in direction A so that the end in which connector 6*b* is attached is no longer in contact with the locking posts 22, 24. At this point, the magnetic attraction pulls and aligns housing 12 and housing 10 so that the top surface 2*b* of housing 12 lays flat on the bottom surface 3*a* of housing 10 and the connector 6*b* of housing 12 falls between the two locking post of housing 19. Also, during this alignment of the magnets, the natural attraction of the magnets forces housing 12 to slide along the bottom surface 3*a* of housing 10 in Direction B thereby mating and tightly fitting the notches of housing 12 with the extenders of locking posts 22, 24. This engages the mechanical locking arrangement of the clasp as the extenders are now tightly fitted with the notches of housing 12 thereby mechanically locking the clasp 1. (See FIG. 6). When being worn by a user, a working side of housing 10 of the jewelry clasp, e.g., side 3*b*, can be worn closest to the user's skin so that a design side of housing 12, e.g., side 2*a*, can be viewed or vice versa.

In order to unlock the clasp, a user, e.g., uses an index finger and a thumb. By placing the locked clasp between these two fingers, the user applies an inward force and forcibly slides the notches of housing 12 out of the locking posts of housing 10 while at the same time breaking the magnetic force of the magnets and unlocking the clasp. For example, if the wearer pushes on both ends the married clasp, e.g., the housing 12 in the direction of the arrow D and housing 10 in the direction of arrow C, the housings 10, 12 can be moved laterally to (1) misalign the married north and south poles and (2) move the opposites poles of the opposite magnets near each other thereby causing a magnetic repulsion between the like poles thereby disengage the magnetic locking arrangement. Once misaligned and disengaged, the housing 10 is free to be moved and separated from housing 12 since the magnetic attraction has been essentially eliminated. As such, the opening of the clasp can be accomplished with one hand without need for actual visual perception of the clasp.

FIGS. 7-10 show one implementation of a magnetic jewelry clasp. The clasp 100 includes two housings 110, 112 adapted to be joined together in a mechanical locking arrangement and a magnetic locking arrangement. The housings 110, 112 can be made of many materials, preferable of the metal material, such as silver or gold that is the same as the material used in the piece of jewelry on which the clasp is being used.

Housing 110 has a length L1 and a width W1 with an overall rectangular shape (please note, the housing can be formed in most shapes, e.g., round, square, etc.). The length of housing 110 can be approximately 5 to 15 mm and the width can be approximately 0.5 to 2 mm. The housing 110 includes a top surface 102*a*, a bottom surface 103*a*, a recess 104*a* for holding a magnet 114, a locking post 122, and a connector 106*a*.

The locking post 122 extends downward from the bottom surface 103*a* of housing 110. At a top portion of the locking post is a locking ball 126. The top surface of the housing may or may not have an ornamental design.

Housing 110 and housing 112 are similar in shape and size with variations for a locking mechanism. As such, housing 112 also has a length L2 and a width W2 with an overall oval shape. The length of housing 112 can be approximately 5 to 15 mm and the width can be approximately 0.5 to 2 mm. Housing 112 includes a top surface 102*b*, a bottom surface 103*b*, a recess 104*b* for holding a magnet 116, a connector 106*b* and a V-shaped holder 130.

The V-shaped holder 130 is connected at a connector end of the housing 12. The V-shaped holder is designed so that the locking post and lock ball can be tightly fitted with the holder. As will be described in more detail below, the locking post, the locking ball and the holder are part of the mechanical locking arrangement of the clasp.

In each recess 104*a*, 104*b* there is a magnetic configuration embedded and affixed within each of the housings 110, 112. The magnetic configuration can comprise permanent magnets 114, 116. The magnets 114, 116 are part of a magnetic locking arrangement for the clasp 100. The permanent magnets 114, 116 can be arranged along a longitudinal line extending between the magnets and the polarity of each of the permanent magnets 114, 116 is predetermined. In some implementations, the line of greatest magnetic attraction between the permanent magnets 114, 116 is perpendicular to a bottom surface 140*a* of magnet 114 and a top surface 140*b* of 116. The top surface 140*a* and the bottom surface 140*b* of the magnets 114, 116 each have a south pole 114*a*, 116*a* and north pole, 114*b*, 116*b*, respectively. The magnets 114, 116, as well as the other magnets described herein with respect to other embodiments of the invention, can be, e.g., bi-polar rare-earth neodymium magnets, sintered, N50 strength, with strongest magnetic power through the thickness. Such magnets have the strongest magnetic power for their size of any known current magnet, however, magnets with lesser power can perform effectively in the present clasp design. The magnets are preferably nickel plated to improve the appearance and prevent surface abrasion or corrosion.

In use, a user brings the two clasps in close proximity to each other and the clasp will naturally align with one another. That is, the south pole 114*a* of magnet 114 aligns with the north pole 116*b* of magnet 116 and the south pole 116*a* of magnet 116 is aligns with the north pole 114*b* of magnet 116. Thus, the magnetically attractive surfaces 118, 120 are attracted to each other by the mating of the opposite poles of the individual magnets. However, when the two housing 110, 112 are first attracted to each other, the locking post and ball interferes with the magnetic locking arrangement and does not allow the magnets to lie flat against one another. (See FIG. 9). To lock the clasp, a user pushes housing 112 in direction A so that the end in which the connector 106*a* is attached no longer in contact with the locking post. At this point, the magnetic attraction pulls and aligns housing 112 towards housing 110 so that the top surface 103*b* of housing 112 lays flat on the top surface 103*a* of housing 110 and the locking post and ball falls into an opening created by the V-shaped holder. During this alignment of the magnets, the natural attraction of the magnets forces housing 112 to slide along the top surface of housing 110 in Direction B thereby tightly fitting the locking post and ball into the groove of the V-shaped holder. This engages the mechanical locking arrangement of the clasp as the locking post and ball are now tightly fitted within the V-shaped holder thereby locking the clasp 100. (See FIG. 10). When being worn by a user, a working side of housing 110 of the jewelry clasp, e.g., side 103*b*, can be worn closest to the user's skin so that a design side of housing 112, e.g., side 102*a*, can be viewed.

In order to unlock the clasp, a user, e.g., uses an index finger and a thumb. By placing the locked clasp between these two fingers, the user applies an inward force and forcibly slides the V-shaped holder of housing 112 out of the locking post of housing 110 while at the same time breaking the magnetic force of the magnets and unlocking the clasp. For example, if the wearer simply pushes on both ends the married clasp, e.g., the housing 110 in the direction of the arrow D and housing 112 in the direction of arrow C, the housings 110, 112 can be moved laterally to (1) misalign the married north and south poles and (2) move the opposites poles of the opposite magnets near each other thereby causing a magnetic repulsion between the like poles thereby disengaging the mechanical locking arrangement. Once misaligned and disengaged, the housing 110 is free to be moved and separated from housing 112 since the magnetic attraction has been essentially eliminated. As such, the opening of the clasp can be accomplished with one hand without need for actual visual perception of the clasp.

Figure 11:
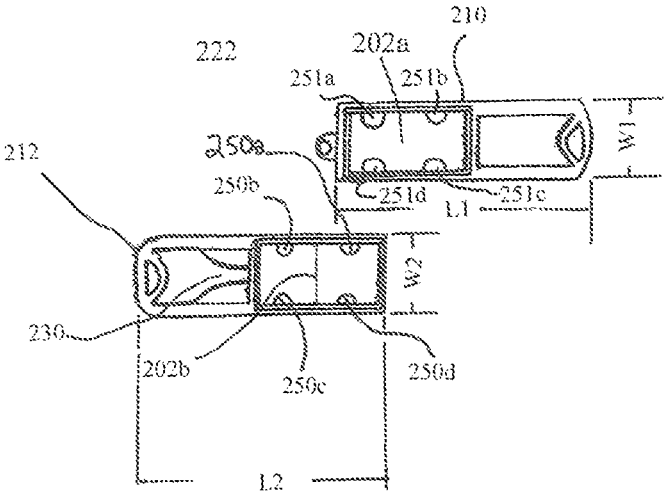
FIG. 11 shows an underside of a first housing and a top surface of a second housing of an unconnected jewelry clasp of the disclosed technology.
Figure 12:
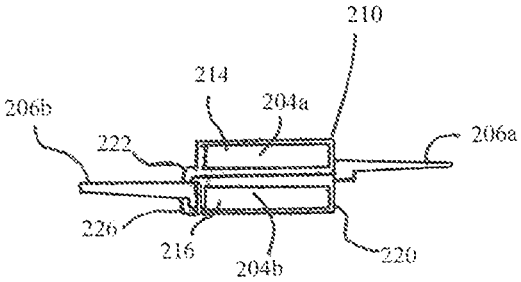
FIG. 12 shows a side view of a connected jewelry clasp of the disclosed technology.
Figure 13:
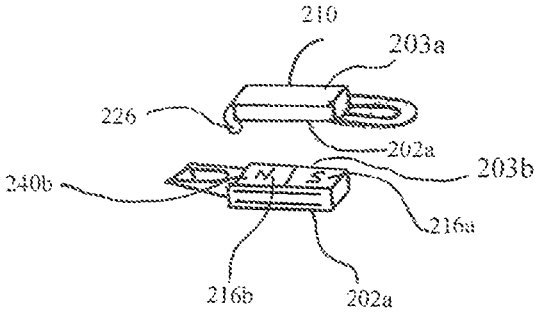
FIG. 13 shows a prospective view of an unconnected jewelry clasp of the disclosed technology.
Figure 14A:
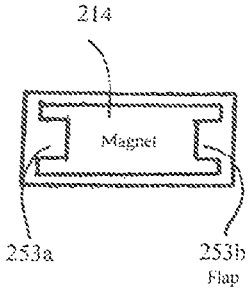
FIG. 14*a-c* shows top views of housings with a variety of flaps for holding magnets within the housing used with jewelry clasps of the disclosed technology.
Figure 14B:
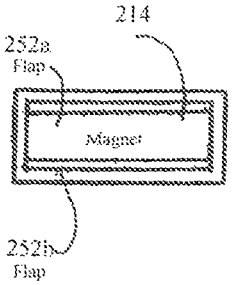
Figure 14C:
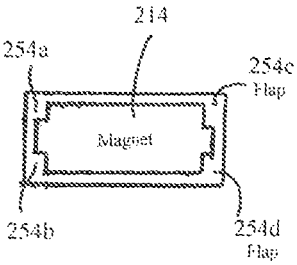
Figure 15A:
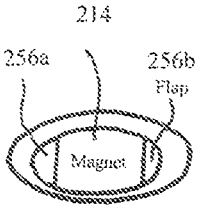
FIG. 15*a-b* shows top views of housings with a variety of flaps for holding magnets within the housing used with jewelry clasps of the disclosed technology.
Figure 15B:
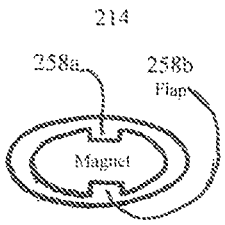

FIGS. 11-13 show another implementation of a magnetic jewelry clasp. The clasp 200 includes two housings 210, 212 adapted to be joined together in a mechanical locking arrangement and a magnetic locking arrangement. The housings 210, 212 can be made of many materials, preferable of the metal material, such as silver or gold that is the same as the material used in the piece of jewelry on which the clasp is being used.

Housing 210 has a length L1 and a width W1 with an overall rectangular shape (please note, the housing can be formed in most shapes, e.g., round, square, etc.). The length of housing 210 can be approximately 5 to 15 mm and the width can be approximately 0.5 to 2 mm. The housing 210 includes a bottom surface 202*a*, a top surface 203*a*, a recess 204*a* for holding a magnet 214, a locking post 222, and a connector 206*a*.

The locking post 122 extends downwards from the top surface of housing 210. At a top portion of the locking post is a locking hook 226. The top surface 203*a* of the housing may or may not have an ornamental design.

Housing 210 and housing 212 are similar in shape and size with variations for a locking mechanism. As such, housing 212 also has a length L2 and a width W2 with an overall oval shape. The length of housing 212 can be approximately 5 to 15 mm and the width can be approximately 0.5 to 2 mm. Housing 212 includes a top surface 202*b*, a bottom surface 203*b*, a recess 204*b* for holding a magnet 216, a connector 206*b* and a V-shaped holder 230.

The V-shaped holder 230 is connected at a connector end of the housing 212. The V-shaped holder is designed so that the locking post 222 and lock hook 226 can be locked with the holder 230. As will be described in more detail below, the locking post, the locking hook and the holder are part of the mechanical locking arrangement of the clasp.

In each recess 204*a*, 204*b* there is a magnetic configuration embedded and affixed within each of the housings 210, 212. The magnetic configuration can comprise permanent magnets 214, 216. The magnets 214, 216 are part of a magnetic locking arrangement for the clasp 200. The magnets can be held within their respective recesses by tabs 250*a-d* and 251*a-d*. FIGS. 14*a-c* and 15*a-b* show magnets held in place with different flap configurations, e.g., in FIG. 14*a*, magnet 214 can be held in place by flaps 253*a*, 253*b*, in FIG. 14*b*, magnet 214 can be held in place by flaps 252*a*, 252*b* in FIG. 14*c*, magnet 214 can be held in place by flaps 254*a*, 254*b*, 254*c*, 254*d*, in FIG. 15*a*, magnet 214 can be held in place by flaps 256*a*, 256*b* and in FIG. 15*b*, magnet 214 can be held in place by flaps 258*a*, 258*b*. In these implementations, the flaps or tabs are folded on a top side or bottom side of the magnets and lay on top of the magnets. The permanent magnets 214, 216 can be arranged along a longitudinal line extending between the magnets and the polarity of each of the permanent magnets 214, 216 is predetermined. In some implementations, the line of greatest magnetic attraction between the permanent magnets 214, 216 is perpendicular to a top surface 240*a*, 240*b* of the magnets. The bottom surface 240*a* of the magnet 214 and the top surface 240*b* of magnet 216 each have a south pole 214*a*, 216*a* and north pole, 214*b*, 216*b*, respectively.

The magnets 214, 216, as well as the other magnets described herein with respect to other embodiments of the invention, can be, e.g., bi-polar rare-earth neodymium magnets, sintered, N50 strength, with strongest magnetic power through the thickness. Such magnets have the strongest magnetic power for their size of any known current magnet, however, magnets with lesser power can perform effectively in the present clasp design. The magnets are preferably nickel plated to improve the appearance and prevent surface abrasion or corrosion.

In some implementations, the jewelry clasps can be made in various shapes, e.g., rectangular, round, oval, etc., in narrow and wide versions and in various sizes so as to tie in with and look attractive with different sizes and styles of necklaces and bracelets or match the jewelry chain. The jewelry clasps also may have ornamental designs on one or more surfaces of the housing.

While this specification contains many specific implementation details, these should not be construed as limitations on the scope of the disclosed technology or of what can be claimed, but rather as descriptions of features specific to particular implementations of the disclosed technology. Certain features that are described in this specification in the context of separate implementations can also be implemented in combination in a single implementation. Conversely, various features that are described in the context of a single implementation can also be implemented in multiple implementations separately or in any suitable subcombination. Moreover, although features can be described above as acting in certain combinations and even initially claimed as such, one or more features from a claimed combination can in some cases be excised from the combination, and the claimed combination can be directed to a subcombination or variation of a subcombination.

The foregoing Detailed Description is to be understood as being in every respect illustrative, but not restrictive, and the scope of the disclosed technology disclosed herein is not to be determined from the Detailed Description, but rather from the claims as interpreted according to the full breadth permitted by the patent laws. It is to be understood that the implementations shown and described herein are only illustrative of the principles of the disclosed technology and that various modifications can be implemented without departing from the scope and spirit of the disclosed technology.

The invention claimed is:

1. A jewelry clasp comprising:

a first housing for securing a first magnetic configuration, the first magnetic configuration having an exposed face with a north pole being positioned at a first side of the exposed face and a south pole being positioned at a second side of the exposed face, the first housing further including a first locking member;

a second housing for securing a second magnetic configuration, the second magnetic configuration having an exposed face with a south pole being positioned at a first side of the exposed face and a north pole being positioned at a second side of the exposed face, the second housing further including a second locking member;

a magnetic locking arrangement wherein the north pole and the south pole of the first magnetic configuration are magnetically attracted and aligned with the south pole and the north pole of the second magnetic configuration to engage the magnetic locking arrangement and wherein the first housing member is moved laterally with respect to the second housing member to disengage the magnetic locking arrangement, the lateral movement causing a magnetic repulsion between one of the north pole and the south pole of the first magnetic configuration and a like pole of the second magnetic configuration; and a mechanical locking arrangement wherein the first locking member slidably interlocks with a second locking member during alignment of the magnetic locking arrangement.

2. The jewelry clasp of claim 1 wherein the first magnetic configuration is a bipolar magnet.

3. The jewelry clasp of claim 1 wherein the first magnetic configuration is two magnets of different poles being placed adjacent one another.

4. The jewelry clasp of claim 1 wherein the first locking member includes at least two posts and at least two post extenders.

5. The jewelry clasp of claim 4 wherein the second locking member includes at least two notches.

6. The jewelry clasp of claim 5 wherein the at least two posts and the at least two post extenders slidably interlock with the at least two notches.

7. The jewelry clasp of claim 1 wherein the first locking member includes at least one post and hook.

8. The jewelry clasp of claim 7 wherein the second locking member includes at least one V-shaped holder.

9. The jewelry clasp of claim 8 wherein the at least one post and hook slidably interlocks with the at least one V-shaped holder.

10. The jewelry clasp of claim 1 wherein the first housing and the second housing have an ornamental design on at least one surface thereof.

11. A jewelry clasp comprising:

a first housing for securing a first magnetic configuration, the first magnetic configuration having an exposed face with a north pole being positioned at a first side of the exposed face and a south pole being positioned at a second side of the exposed face, the first housing further including a first locking member a second housing for securing a second magnetic configuration, the second magnetic configuration having an exposed face with a south pole being positioned at a first side of the exposed face and a north pole being positioned at a second side of the exposed face, the second housing further including a second locking member;

a magnetic locking arrangement wherein the north pole and the south pole of the first magnetic configuration are magnetically attracted and aligned with the south pole and the north pole of the second magnetic configuration; and a mechanical locking arrangement wherein the first locking member slidably interlocks with a second locking member during alignment of the magnetic locking arrangement, wherein the first locking member includes at least one post and ball.

12. The jewelry clasp of claim 11 wherein the second locking member includes at least one holder.

13. The jewelry clasp of claim 12 wherein the at least one post and ball slidably interlocks with the at least one holder.

* * * * *